US006279896B1

(12) United States Patent
Linder et al.

(10) Patent No.: US 6,279,896 B1
(45) Date of Patent: Aug. 28, 2001

(54) SYSTEMS AND METHODS FOR DYNAMICALLY SETTING AIR SYSTEM PRESSURES BASED ON REAL TIME SHEET ACQUISITION TIME DATA

(75) Inventors: Michael J. Linder, Walworth; Kenneth P. Moore, Rochester; Richard L. Dechau, Macedon; William R. Haag, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/416,417

(22) Filed: Oct. 12, 1999

(51) Int. Cl.[7] ..... B65H 3/14

(52) U.S. Cl. ..... 271/98; 271/105; 271/107; 271/108; 271/30.1; 271/31

(58) Field of Search ..... 271/11, 98, 105, 271/107, 108, 30.1, 31

(56) References Cited

U.S. PATENT DOCUMENTS 5,184,813 * 2/1993 Schwitzky et al. ..... 271/105
5,290,023 * 3/1994 Sasaki et al. ..... 271/105
5,645,274 * 7/1997 Ubayashi et al. ..... 271/105
5,893,554 * 4/1999 Okahashi et al. ..... 271/98
5,988,624 * 11/1999 Nakagawa ..... 271/11
6,082,728 * 7/2000 Ubayashi ..... 271/105
6,123,330 * 9/2000 Schaal ..... 271/31

FOREIGN PATENT DOCUMENTS

2835385 * 5/1979 (DE) ..... 271/31

* cited by examiner

*Primary Examiner*—H. Grant Skaggs
(74) *Attorney, Agent, or Firm*—Oliff & Berridge. PLC

(57) ABSTRACT

A sheet feeder feeds sheets separated from a stack to a feed head which is translatable toward take away nip rolls. The sheets are separated from the stack by fluffers and acquired by an acquisition surface of the feed head which is in communication with a vacuum pressure. An air knife is used, in conjunction with a corrugation surface, to separate any secondarily acquired sheets from the acquisition surface. The time for acquiring the sheet is determined from the opening of a vacuum valve in communication with the feed head to the acquiring of the sheet by the acquisition surface. The time for acquiring the sheets is dependent on the sheet characteristics. A controller adjusts the pressure to the fluffers, air knife and the vacuum pressure to control the sheet acquisition time based on the sheet acquisition times of a predetermined number of previously successfully fed sheets and a standard deviation as compared to a table of predetermined sheet acquisition times and standard deviations for the particular sheet characteristics.

19 Claims, 10 Drawing Sheets

SYSTEMS AND METHODS FOR DYNAMICALLY SETTING AIR SYSTEM PRESSURES BASED ON REAL TIME SHEET ACQUISITION TIME DATA

BACKGROUND OF THE INVENTION

1. Field of Invention

This invention relates generally to a sheet feeder for an image forming engine of an image forming apparatus.

2. Description of Related Art

To supply image recording media, generally referred to as "sheets", to the image forming engine, individual copy sheets are acquired from the top of a stack and are transported forward by a translating vacuum feed head into a set of take away nip rolls. Sheet fluffers separate a sheet from the top of the stack and the translating vacuum feed head acquires the separated sheet and feeds the separated sheet into the set of take away nip rolls. The time for the translating vacuum feed head to acquire the sheet is relatively short. If the fluffing or vacuum pressures increase, the sheet acquisition time decreases. Accordingly, the risk of more than one sheet being moved into the take away nip rolls (i.e., a multifeed error) also increases. If fluffing pressure decreases, the top sheet may not get close enough to the translating vacuum feed head which may result in no sheet being fed (i.e., a misfeed error) or in late acquisition of the sheet when the translating vacuum feed head moves forward toward the take away nip rolls. The fluffer and vacuum pressures are determined by paper characteristics, such as the sheet basis weight measured in grams per square meter (gsm), size and coating, which are input by the user or determined automatically by sensors in the image forming apparatus.

SUMMARY OF THE INVENTION

In accordance with an exemplary embodiment of the system and method according to this invention, a sheet feed apparatus for an image forming apparatus includes a vacuum source that is selectively actuable, a translating vacuum feed head attached to the vacuum source to acquire the top sheet of the stack, a unidirectional rotating drive mechanism, and a control circuit. The unidirectional rotating drive mechanism is driven in a single direction while causing the translating vacuum feed head to reciprocate from a first position to a second position. The control circuit dynamically adjusts the positive pressures and the vacuum pressure to prevent multifeed, misfeed and/or late acquisition. The sheet acquisition time is the time interval between opening of a vacuum manifold valve and the acquisition of the sheet by the translating vacuum feed head. In one exemplary embodiment, the control circuit controls the sheet acquisition time based on a running average and standard deviation of a predetermined number of previously successfully fed sheets.

Other features of the invention will become apparent as the following description proceeds and upon reference to the drawings.

DESCRIPTION OF THE PREFERRED EMBODIMENTS

Figure 1:
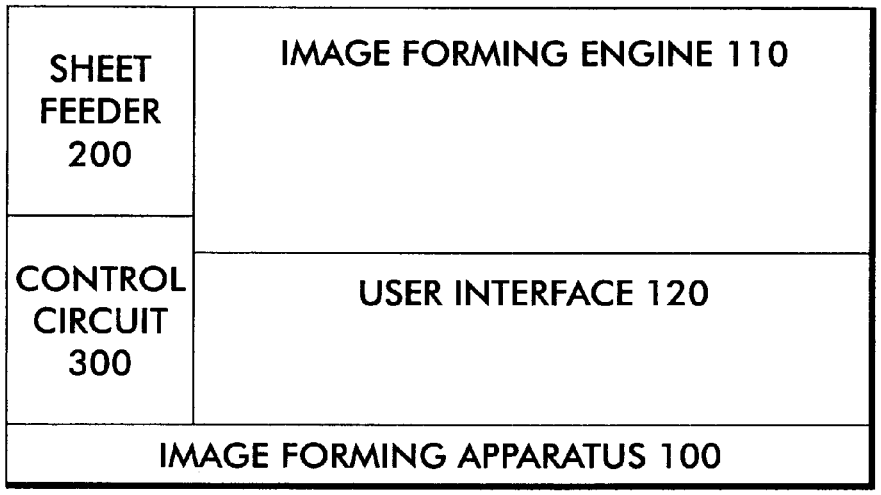
FIG. 1 is a schematic of an image forming apparatus according to the invention.

FIG. 1 is a schematic of an image forming apparatus 100 of an exemplary embodiment of the invention. The image forming apparatus 100 has an image forming engine 110 for fixing an image to a sheet of recording media. A user interface 120 allows a user of the image forming apparatus 100 to input a print request, including a total number of sheets to be printed. The user can also input the characteristics of the sheets to be printed. The characteristics may include the sheet basis weight, the size of the sheet, and the coating on the sheet. A sheet feeder 200 separates a sheet from the top of a stack, acquires the separated sheet and delivers the separated sheet to the image forming engine 110. A control circuit 300 controls the sheet acquisition time based on a running average and standard deviation of a predetermined number of previously successfully fed sheets. The control circuit 300 also adjusts the position of the stack and controls the take away nip rolls that receive the acquired sheet and deliver the sheet to the image forming engine 110.

Figure 2:
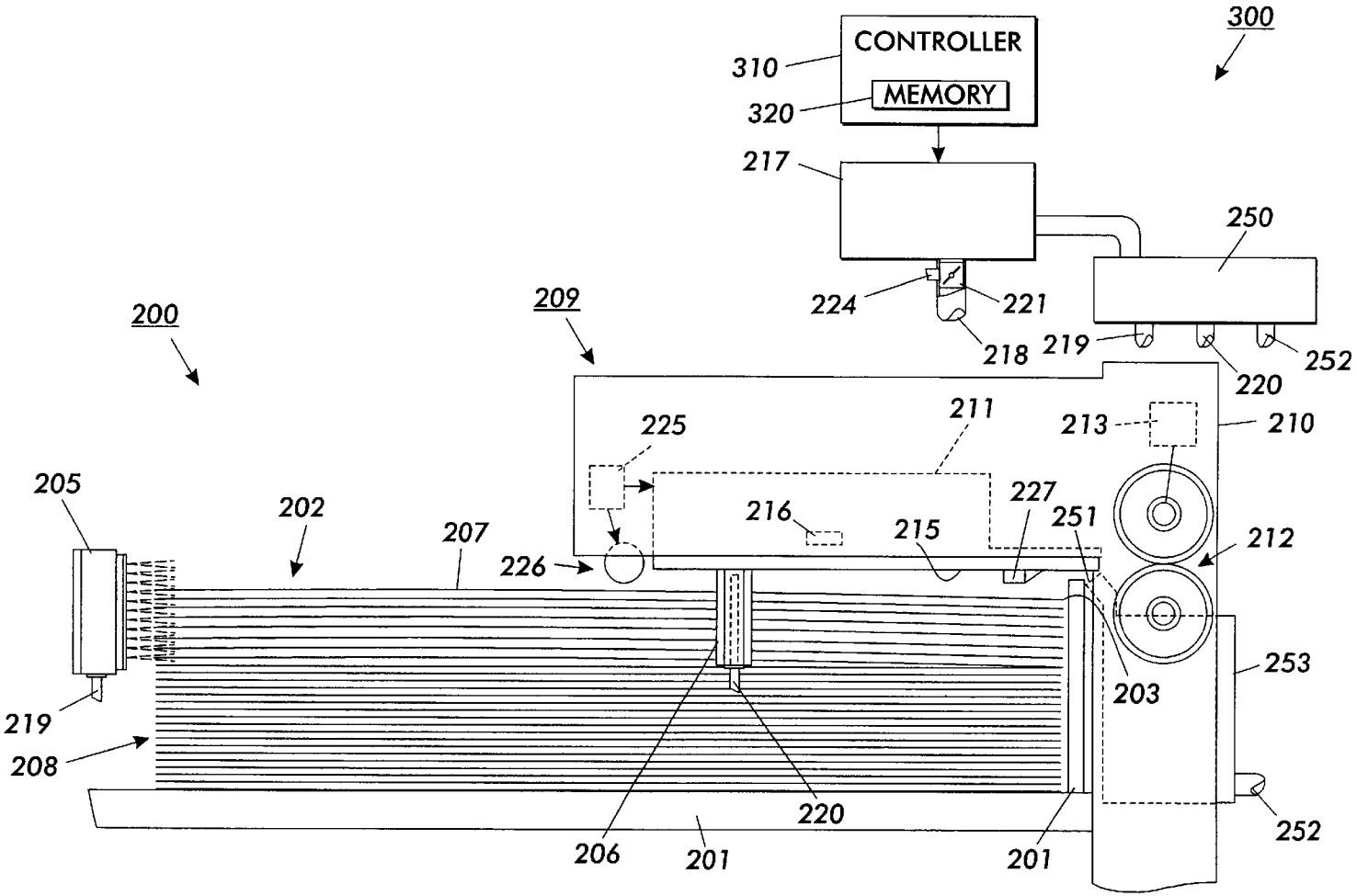
FIG. 2 is a side view schematically illustrating the sheet feeder according to the invention.

FIG. 2 is a side elevation schematic view of one exemplary embodiment of the sheet feeder 200 and control circuit 300 according to the invention. The sheet feeder 200 includes a support tray 201 that is tiltable and self adjusting to accommodate sheets having various characteristics. A stack 202 of sheets is supported on the sheet support tray 201 so that the leading edge 203 of the stack 202 abuts a registration wall 204. Sheet fluffers 205 and 206 blow air against the stack 202 to separate the top sheet 207 from the stack 202. The trailing edge sheet fluffer 205 blows air at a trailing edge 208 of the stack 202. Two side edge sheet fluffers 206, only one of which can be seen in FIG. 2, blow air at opposing sides of the stack 202.

A feed head assembly 209 includes a housing 210 that supports a translating vacuum feed head 211 for movement toward and away from the pair of take away nip rolls 212. The take away nip rolls 212 are driven by a stepper motor 213. A sheet acquisition sensor 216 in the translating vacuum feed head 211 detects acquisition of the top sheet 207 by an acquisition surface 215 of the translating vacuum feed head 211. Vacuum pressure is applied to the translating vacuum feed head 211 by a blower assembly 217 through a vacuum manifold 218. In an exemplary embodiment, the blower assembly 217 includes a variable speed brushless DC motor.

Air is supplied from the blower assembly 217 to a positive pressure plenum 250. Air is supplied from the positive pressure plenum 250 to the sheet fluffers 205 and 206 through fluffer manifolds 219 and 220, respectively. Air is also supplied from the positive pressure plenum 250 to an air knife 251. The air is supplied from the positive pressure plenum 250 to an air knife plenum 253 through an air knife manifold 252. The air knife 251 separates any secondarily acquired sheets from the top sheet 207 acquired by the acquisition surface 215. Secondarily acquired sheets are sheets that stick to the top sheet 207 acquired by the acquisition surface 215.

The vacuum manifold 218 is opened and closed by a vacuum manifold valve 221. Opening the vacuum manifold valve 221 allows vacuum pressure to be applied to the translating vacuum feed head 211 by the blower assembly 217. In an exemplary embodiment, the vacuum manifold valve 221 is opened by a stepper motor. A vacuum manifold valve sensor 224 detects the opening of the vacuum manifold valve 221. A signal is sent to the control circuit 300 when the vacuum manifold valve sensor 224 detects that the vacuum manifold valve 221 has been opened.

The housing 210 of the feed head assembly 209 also supports a unidirectional rotating drive mechanism 225 for the translating vacuum feed head 211, a stack height sensor 226 and a lead edge attitude sensor 227. The stack height sensor 226 is also driven by the unidirectional rotating drive mechanism 225 to contact the top of the stack 202 after a trailing edge of the top sheet 207 that has been fed by the translating vacuum feed head 211 to the take away nip rolls 212 passes the stack height sensor 226. The stack height sensor 226 and the lead edge attitude sensor 227 are used to control the position of the support tray 201.

The control circuit 300 includes a controller 310 having a memory 320. In an exemplary embodiment, the controller 310 receives signals from the vacuum manifold valve sensor 224 and the sheet acquisition sensor 216 in the feed head assembly 209 and controls the blower assembly 217 in response to the signals. In another exemplary embodiment, the controller 310 also receives signals from the vacuum manifold valve sensor 224 and the lead edge attitude sensor 227 and controls the blower assembly 217 in response to the signals. The controller 310 also receives a signal from the stack height sensor 226 and the lead edge attitude sensor 227 to control the position of the support tray 201 in response to the signals. The controller 310 also controls the stepper motor 213 that drives the take away nip rolls 212 by executing a control program stored in the memory 320.

Figure 3:
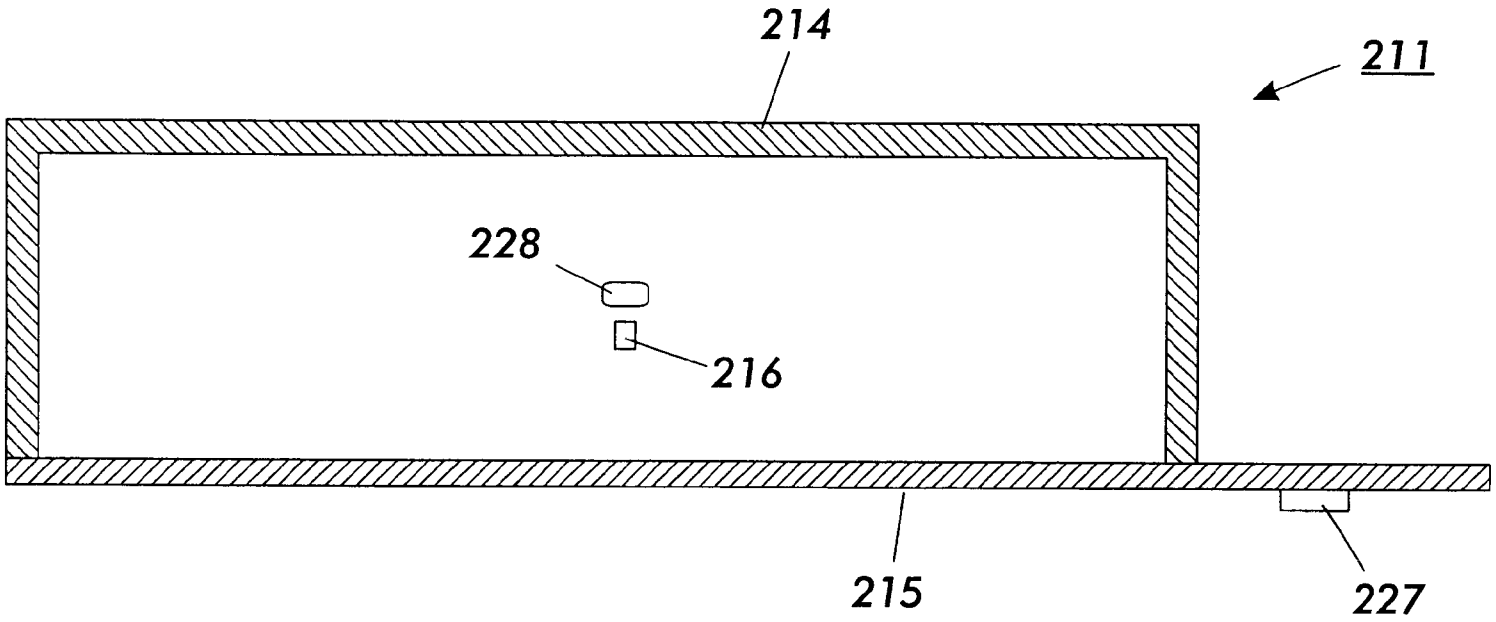
FIG. 3 is a side sectional view of the feed head.

FIG. 3 is a schematic side elevation sectional view of the translating vacuum feed head 211. The translating vacuum feed head 211 includes a plenum 214 and the acquisition surface 215. In an exemplary embodiment, the plenum 214 is formed of an injection molded plastic. The plenum 214 includes a port 228 formed in one side which is connected to the vacuum manifold 218. The junction of the port 228 and the vacuum manifold 218 includes a sliding seal (not shown) that allows the translating vacuum feed head 211 to move toward and away from the take away nip rolls 212 while maintaining the connection to the vacuum manifold 218. A pressure measured at the junction of the port 228 and the vacuum manifold 218 when a sheet is acquired is defined as a sealed port pressure.

The sheet acquisition sensor 216 is mounted in the plenum 214 near the port 228 and the lead edge attitude sensor 227 is mounted at a forward side of the plenum 214. Sheet acquisition can be detected by either the sheet acquisition sensor 216 or the lead edge attitude sensor 227.

Figure 4:
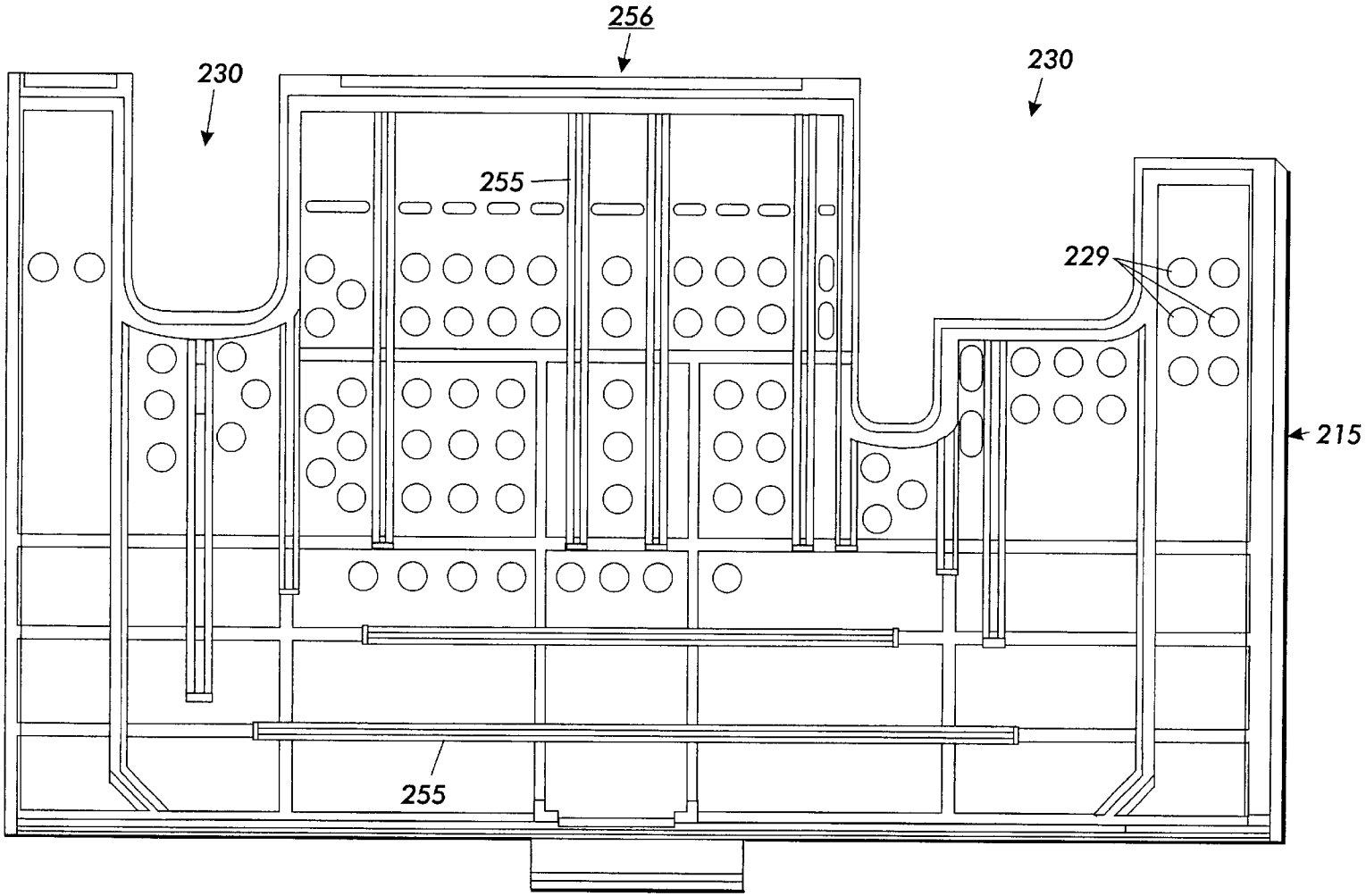
FIG. 4 is a plan view of the corrugation plate of the feed head.

As shown in FIG. 4, the acquisition surface 215 includes a corrugation plate 256. The corrugation plate 256 includes a plurality of corrugating ribs 255, a plurality of apertures 229 and a plurality of cut-outs 230 where the corrugation plate 256 will surround the take away nip rolls 212 when the translating vacuum feed head 211 is in the forward position. The acquisition surface 215 is an elastomer as acquired sheets are corrugated to improve sheet separation and are then frictionally moved by the corrugation plate 256 as the vacuum feed head 211 is driven forward by the unidirectional rotating drive mechanism 225. As the lead edge of the acquired sheet is delivered to the take away nip rolls 212 the vacuum manifold valve 221 is closed to prevent drag on the sheet due to contact with the acquisition surface 215. The corrugation plate 256 may be replaced if the acquisition surface 215 becomes worm. The corrugation plate 256 may also be replaced by a different corrugation plate having a different number of apertures and/or apertures of a different size depending on the characteristics of the sheets to be fed.

The sheet acquisition sensor 216 detects the acquisition of the top sheet 207 by the translating vacuum feed head 211. In an exemplary embodiment, the sheet acquisition sensor 216 detects a deflection of the acquisition surface 215. When the top sheet 207 is acquired by the translating vacuum feed head 211, the top sheet 207 covers the apertures 229 in the corrugation plate 256. As vacuum pressure is applied to the plenum 214 by the blower assembly 217, the vacuum pressure will cause the corrugation plate 256 to bow upwardly into the plenum 214. The sheet acquisition sensor 216 detects the deflection of the corrugation plate 256. The amount of deflection is dependent on the characteristics of the sheet. The amounts of deflection produced when sheets of varying characteristics are acquired by the translating vacuum feed head 211 are experimentally determined and the results are stored in the memory 320 of the controller 310. The sheet acquisition sensor 216 sends a signal to the controller 310 indicating the deflection of the corrugation plate 256. When the deflection is equal to, or a specified percentage of, the amount of deflection stored in the memory 320 for the particular characteristics of the sheets being fed, the controller 310 determines that the top sheet 207 has been acquired by the translating vacuum feed head 211.

In another exemplary embodiment, the sheet acquisition sensor 216 detects the sealed port pressure produced when the translating vacuum feed head 211 acquires the top sheet 207. When the top sheet 207 is acquired, the apertures 229 in the corrugation plate 256 are covered. As vacuum pressure is applied to the plenum 214 by the blower assembly 217, the sealed port pressure will increase. The sealed port pressure produced when sheets of varying characteristics are acquired by the translating vacuum feed head 211 are experimentally determined and the results are stored in the memory 320 of the controller 310. The sheet acquisition sensor 216 sends a signal to the controller 310 indicating the sealed port pressure. When the sealed port pressure is equal to, or a specified percentage of the sealed port pressure stored in the memory 320 for the particular characteristics of the sheets being fed, the controller 310 determines that the top sheet 207 has been acquired by the translating vacuum feed head 211.

In another exemplary embodiment, the lead edge attitude sensor 227 detects sheet acquisition. The lead edge attitude sensor 227 may include a position sensitive device or multiple sensors with different focal lengths. In an exemplary embodiment, the lead edge attitude sensor 227 is an infrared LED with 4 detectors which determine the location of the lead edge of the top sheet 207 within a range of 0 mm–3 mm, 3 mm–6 mm, 6 mm–9 mm or greater than 9 mm from the acquisition surface 215. The lead edge attitude sensor 227 sends a signal to the controller 310. When the signal indicates that the lead edge of the top sheet 207 is in the 0–3 mm range, the controller 310 determines that the top sheet 207 has been acquired.

Figure 5:
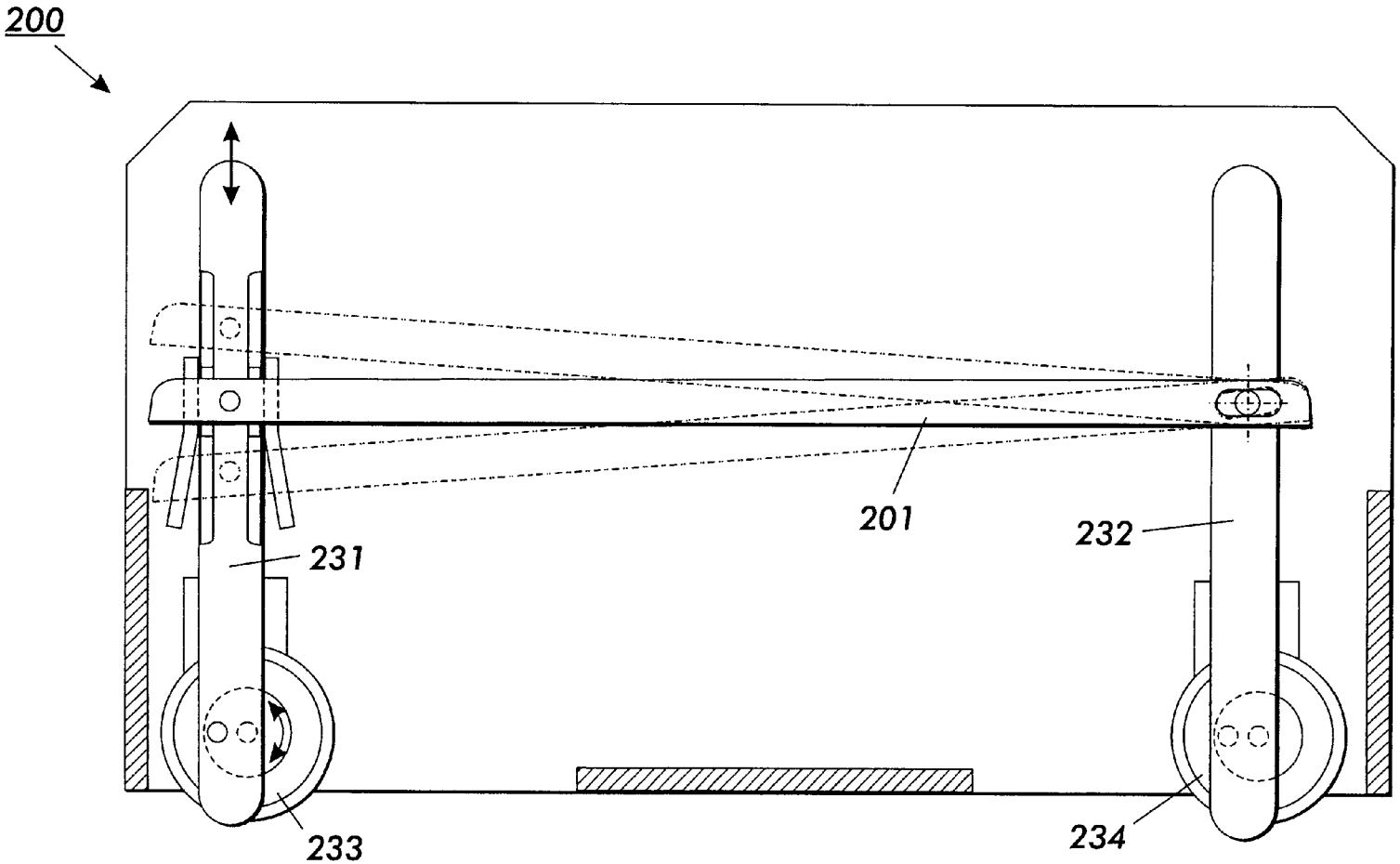
FIG. 5 is a schematic side view of the support tray and elevators of the sheet feeder.

To feed sheets from the sheet feeder 200 to the image forming engine 110, the stack 202 is placed on the support tray 201. As shown in FIG. 5, the support tray 201 is supported at both ends by elevators 231 and 232. Each elevator 231 and 232 is driven by an independent motors 233 and 234, respectively. In various exemplary embodiments of the invention, the motors 233 and 234 can be stepper motors or brushless DC motors. The support tray 201 can be raised or lowered and/or tilted by driving one or both of the independent motors 233 and 234. After the stack 202 is loaded, the controller 310 drives the independent motors 233 and 234 to raise the support tray 201 to an initial stack height. Stack height is defined as the distance from the top of the stack 202 to the acquisition surface 215.

The initial stack height is dependent on the sheet characteristics, including the sheet size and sheet basis weight, as input into the user interface. Heavyweight sheets are more difficult to acquire than lightweight sheets and are more prone to misfeed or late acquisition. Accordingly, a stack of heavyweight sheets is initially placed in a range closer to the acquisition surface 215. Lightweight sheets are easier to acquire and are more prone to multifeed. Accordingly, a stack of lightweight sheets is placed in a range further from the acquisition surface 215. The initial stack heights for particular sheets of varying sheet basis weights are determined experimentally and stored in the memory 320. Signals are sent from the stack height sensor 226 and the lead edge attitude sensor 227 to the controller 310. The controller 310 drives the independent motors 233 and 234 to set the initial stack height.

Figure 6:
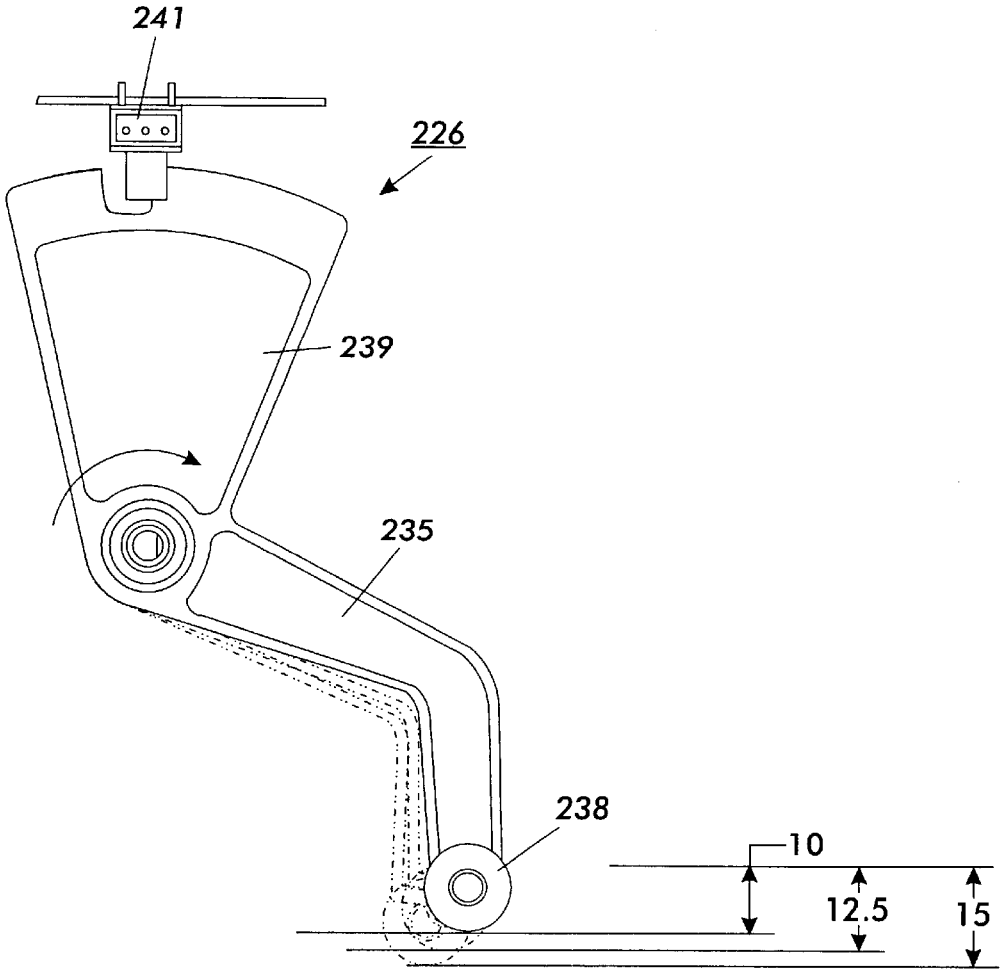
FIG. 6 is a schematic side view illustrating the ranges of the stack height sensor according to the invention.
Figure 7:
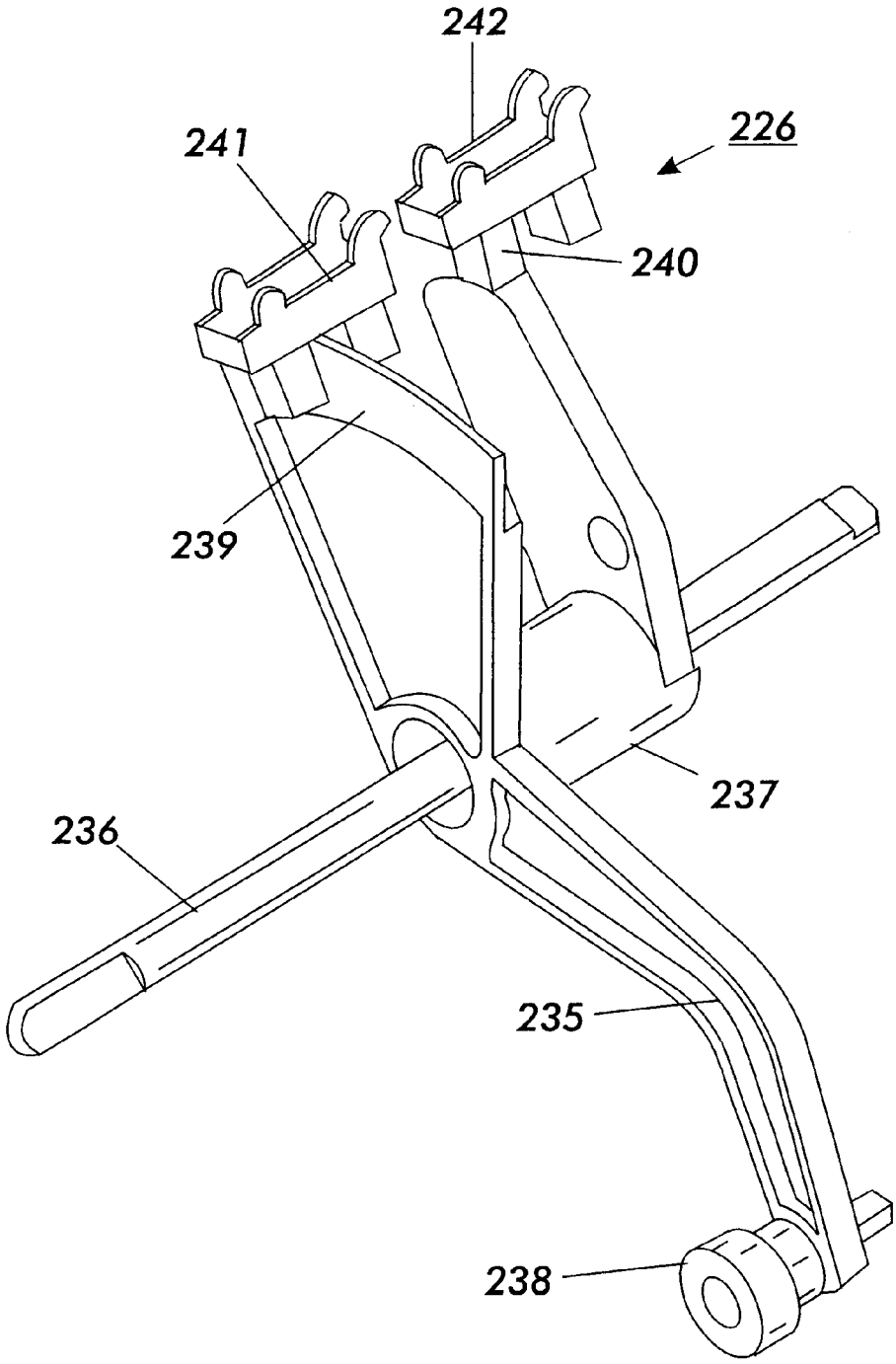
FIG. 7 is a perspective view of the stack height sensor according to the invention.

As shown in FIGS. 6–9, the stack height sensor includes a stack height sensor arm 235 which is pivotably mounted in the housing 210 of the feed head assembly 209 by a shaft 236 passing through a journal 237 at the top of the stack height sensor arm 235. The stack height sensor arm 235 is biased by a spring (not shown) into contact with the top of the stack 202. The housing 210 of the feed head assembly 209 is not shown in FIGS. 6–9 so that the stack height sensor 226 may be more clearly seen. A roller 238 at the end of the stack height sensor arm 235 is movable into and out of contact with the top of the stack 202. As shown in FIG. 7, pair of flags 239 and 240 extend from the journal 237 of the stack height sensor arm 235. The position of each flag 239 and 240 is detected by transmissive sensors 241 and 242, respectively. The positions of the flags 239 and 240, as sensed by the transmissive sensors 241 and 242, respectively, determines the stack height. As shown in FIG. 6, the stack height sensor 226 determines the stack height in one of four ranges: greater than 15 mm, 15 mm 12.5 mm, 12.5 mm–10 mm, and less than 10 mm.

The stack height sensor 226 and the lead edge attitude sensor 227 send signals indicating the stack height to the controller 310 as the controller 310 drives the independent motors 233 and 234 to raise the support tray 201. When the stack height sensor 226 and the lead edge attitude sensor 227 indicate that the stack height is equal to the initial stack height stored in the memory 320 for the particular sheets to be fed, the controller 310 stops driving the independent motors 233 and 234.

Once the stack 202 is set to the initial stack height and a print request is input to the user interface 120, the blower assembly 217 is activated. The trail edge sheet fluffer 205, the side edge sheet fluffers 206, and the air knife 251 are supplied with air from the blower assembly 217 to separate the top sheet 207 from the top of the stack 202. The translating vacuum feed head 211 is supplied with a vacuum pressure by the blower assembly 217. The top sheet 207 is acquired by the translating vacuum feed head 211.

Figure 8:
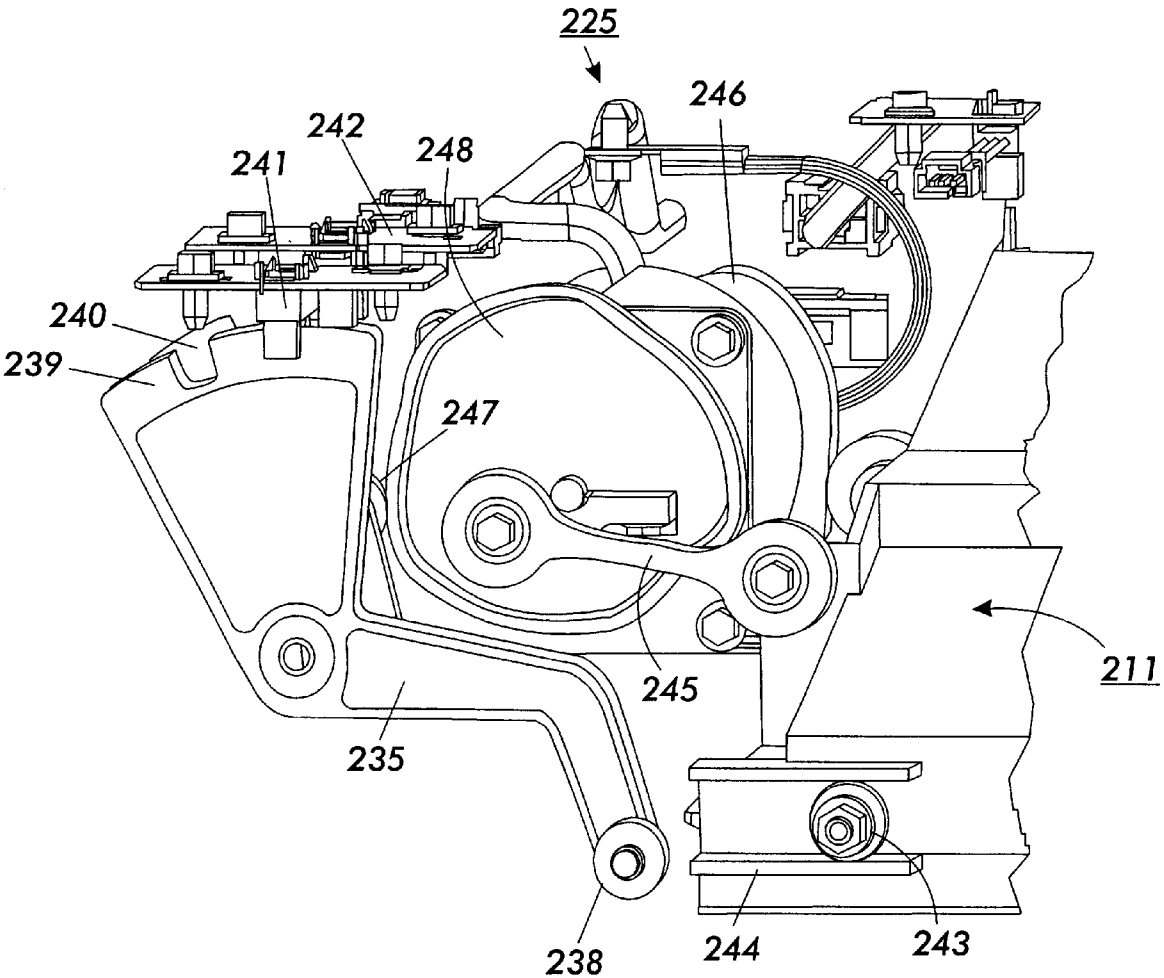
FIGS. 8 and 9 are perspective views of a unidirectional rotating drive mechanism for the feed head and the stack height sensor according to the invention.
Figure 9:
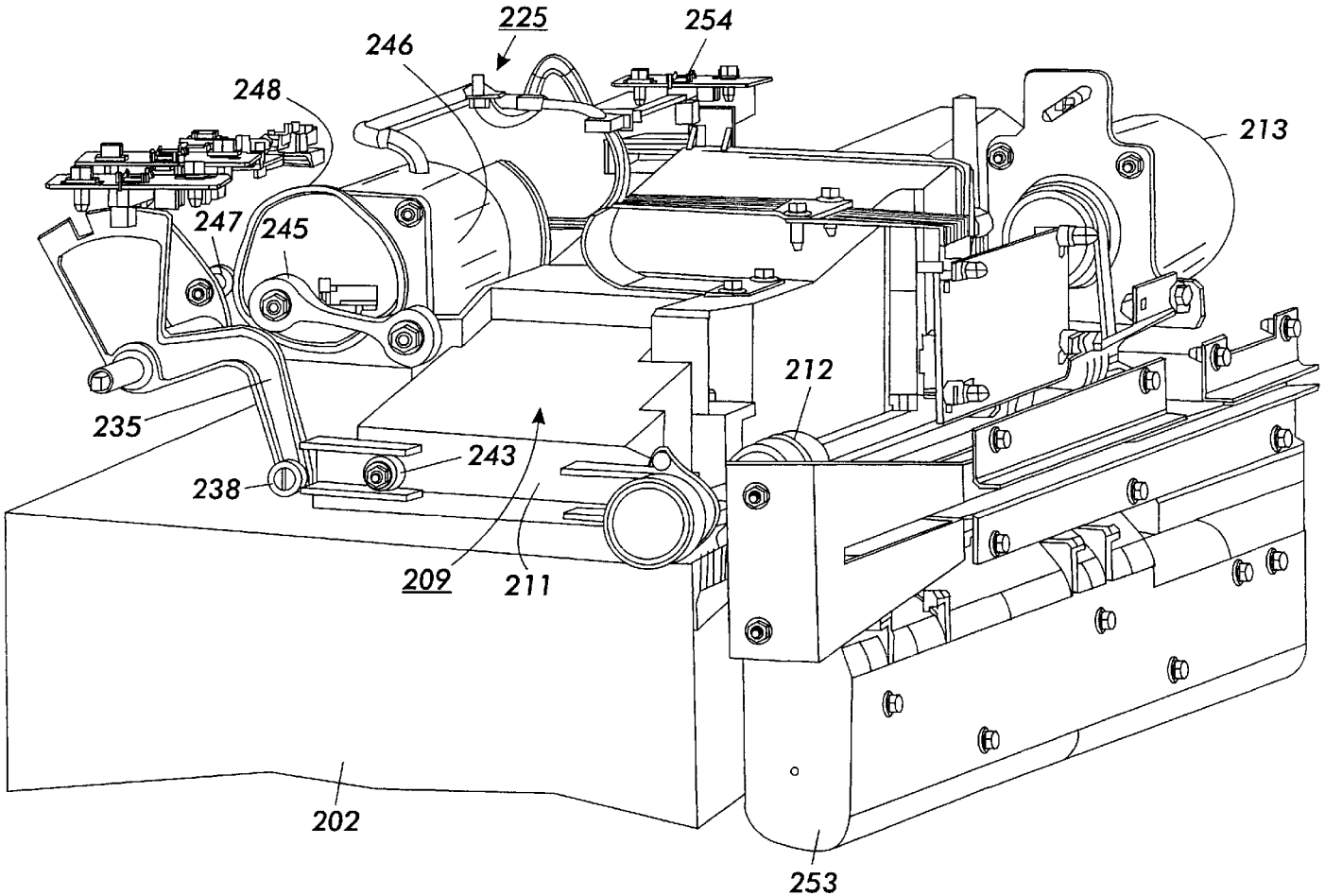

As shown in FIGS. 8 and 9, in an exemplary embodiment, the translating vacuum feed head 211 is supported at each comer by a ball bearing or low friction roller 243 in a slide 244 of the housing (not shown). The translating vacuum feed head 211 is driven forward and returned to a home position by the unidirectional rotating drive mechanism 225. A sensor 254 detects the translating vacuum feed head 211 when the translating vacuum feed head 211 is in the home position. The unidirectional rotating drive mechanism 225 includes two slider-cranks 245, only one of which can be seen in FIGS. 8 and 9. The slider-cranks 245 are mounted on shafts of a unidirectional double shaft stepper motor 246. In an exemplary embodiment, the translating vacuum feed head 211 is driven forward 20 mm and returned 20 mm back to the home position. This includes 5 mm overtravel to account for paper loading tolerance and misregistration.

The unidirectional rotating drive mechanism 225 drives the translating vacuum feed head 211 forward with a velocity profile which delivers the acquired sheet to the take away nip rolls 212 at a speed of, for example, approximately 430 mm/s. The top sheet 207 is delivered to take away nip rolls 212. The take away nip rolls 212 are driven by the stepper motor 213 which is controlled by the controller 310. Once the top sheet 207 is delivered to the take away nip rolls 212, the controller 310 increases the speed of the stepper motor 213 to accelerate the top sheet 207 to match the transport speed of the image forming engine 110.

As shown in FIGS. 8 and 9, the stack height sensor arm 235 includes a cam follower 247. A cam 248 is mounted to a shaft of the double shaft stepper motor 246. The cam 248 includes a portion that engages the cam follower 247 on the stack height sensor arm 235 to lift the roller 238 at the end of the stack height sensor arm 235 out of contact with the top of the stack 202. The cam 248 includes another portion which allows the spring biased stack height sensor arm 235 to drop the roller 238 back into contact with the top of the stack 202.

After the translating vacuum feed head 211 has delivered the top sheet 207 to the take away nip rolls 212, the translating vacuum feed head 211 dwells in the forward position to allow the trailing edge of the top sheet 207 to pass the roller 238, which has been lifted off of the top of the stack 202 by the cam 248. Just before the trailing edge of the top sheet 207 passes the roller 238 of the stack height sensor 226, the dwell ends and the unidirectional drive 225 begins to return the translating vacuum feed head 211 to the home position. Before the translating vacuum feed head 211 reaches the home position, the cam 248 rotates to a position which allows the roller 238 to contact the stack 202.

In an exemplary embodiment, the roller 238 is in contact with the stack 202 for 25 ms. The transmissive sensors 241 and 242 send signals to the controller 310 indicating the stack height. A signal from the lead edge attitude sensor 227 is also sent to the controller 310. As the sheets are fed from the stack 202, the controller 310 adjusts the position of the support tray 201 in response to the signals by driving the independent motors 233 and 234 to maintain the desired stack height and the desired position indicated by the lead edge attitude sensor 227. As the unidirectional rotating drive mechanism 225 returns the translating vacuum feed head 211 to the home position, the cam 248 lifts the roller 238 off the stack 202.

Sheet acquisition time is defined as the time between the opening of the vacuum manifold valve 221 as sensed by the vacuum manifold valve sensor 224 and acquisition of the top sheet 207 by the acquisition surface 215 of the translating vacuum feed head 211 as detected by the sheet acquisition sensor 216 or the lead edge attitude sensor 227. Performance of the sheet feeder 200 may be improved by dynamically adjusting the sheet acquisition time during feeding by adjusting the pressures of the trailing edge sheet fluffer 205, the side edge sheet fluffers 206, the air knife 251 and the vacuum pressure of the translating vacuum feed head 211.

The sheet feeder 200 acquires individual sheets, using positive and negative air pressures supplied from the blower assembly 217 to the sheet fluffers 205 and 206 and to the translating vacuum feed head 211, respectively, from the top of the stack 202 and transports them forward to the take away nip rolls 212. Among the independent variables in the sheet feeder 200 which affect the sheet acquisition time are sheet fluffer pressures and vacuum pressure. As fluffer pressure increases, the sheets on the top of the stack 202 become more separated, with the top most sheets being lifted closer to the translating vacuum feed head 211, thus reducing sheet acquisition time. As the fluffing pressure increases, the risk of multifeed also increases. As the fluffing pressure decreases, the sheets on the top of the stack 202 become less separated from the top of the stack 202, thus increasing the sheet acquisition time. As the fluffing pressure decreases, the risk of misfeed and/or late acquisition increases.

The sheet acquisition time is also a function of the sheet size and sheet basis weight. Predetermined sheet acquisition times for sheets of a particular size and sheet basis weight are experimentally determined and stored in the memory 320. The blower assembly 217 can be dynamically adjusted during sheet feeding to dynamically control sheet acquisition time by using sheet characteristic information input by the operator into the user interface 120 and information from the vacuum manifold valve sensor 224 and the sheet acquisition sensor 216 or the lead edge attitude sensor 227.

Figure 10:
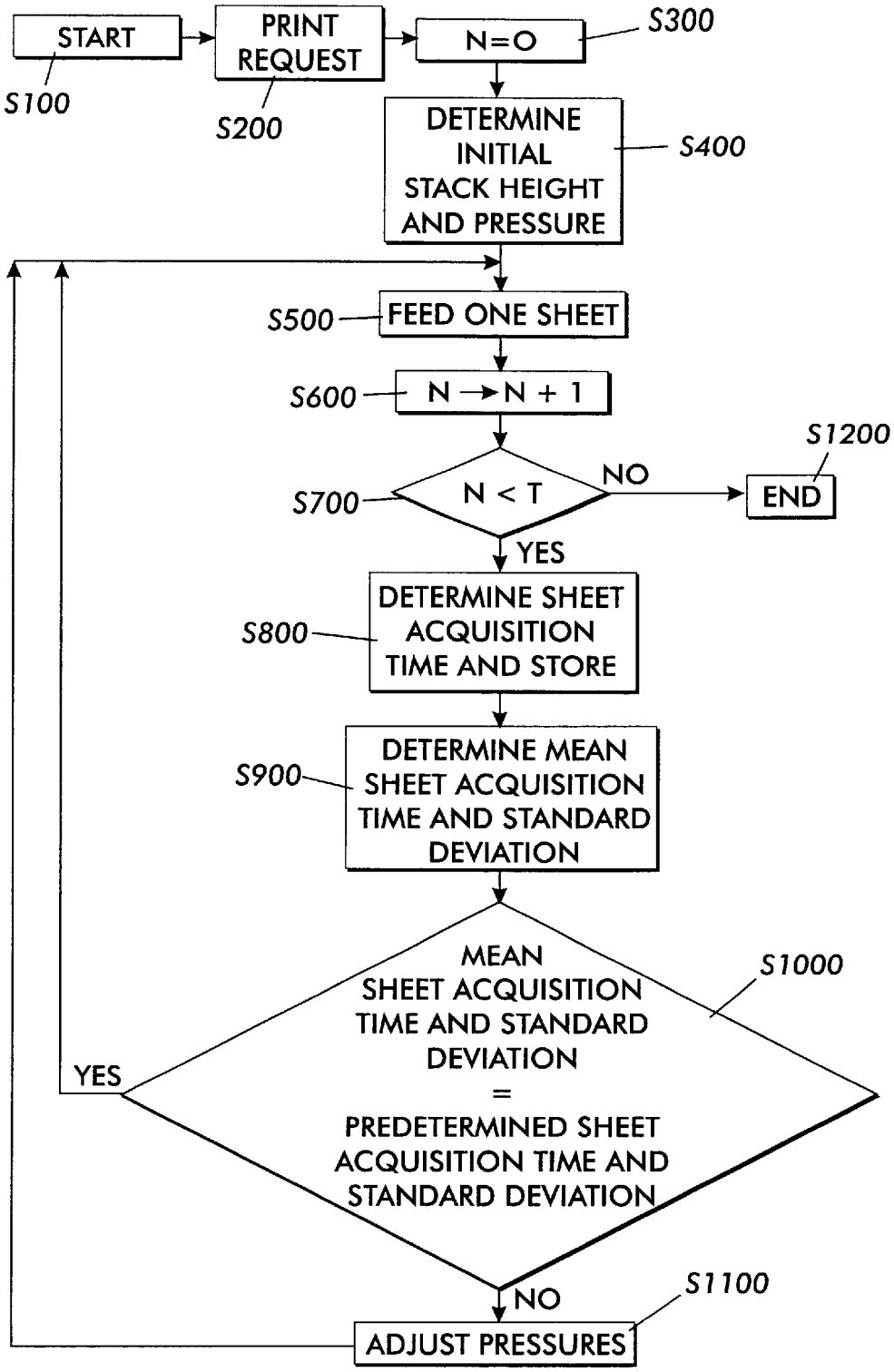
FIG. 10 is a flow chart of a sheet acquisition time adjusting control method according to the invention.

FIG. 10 is a flow chart outlining one exemplary embodiment of a sheet acquisition time adjusting control method according to this invention. Beginning in step S100, control continues to step S200, where a user enters a print request command into the user interface. The print request command includes a total number T of sheets to be printed. Next, in step S300, a counter is set to an initial value N=0. Then, in step S400, the initial stack height and the initial pressure of the sheet fluffers and air knife, and the initial vacuum pressure applied to the translating vacuum feed head are determined. The initial stack height and pressures are set according to the sheet characteristics which are input by the operator or sensed automatically by sensors in the image forming apparatus 100. The initial stack height is set by adjusting the distance between the top of the paper stack and the sheet acquisition surface. The initial pressures are set according to the sheet characteristics by referring to a table of initial pressures which are experimentally determined for the particular sheet characteristics or are set by an equation which is experimentally determined according to the sheet characteristics. The table or equation of initial pressures is stored in a memory. The control then continues to step S500.

In step S500, a first sheet is fed. Then, in step S600, the counter value N is incremented by one. Next, in step S700, the incremented value is compared to the total number T of sheets requested. If the incremented value is equal to the total number T of sheets requested, control jumps to step S1200. Otherwise, if the incremented value is less than the total number of sheets requested, the control continues to step S800.

In step S800, the sheet acquisition time is determined. As previously described, the sheet acquisition time is determined as the time from applying the vacuum pressure to the sheet acquisition surface to acquiring the top sheet.

Next, in step S900, the mean sheet acquisition time and standard deviation for a predetermined number of previously successfully fed sheets are determined. In an exemplary embodiment, the predetermined number is 50. Until the number of sheets actually fed exceeds the predetermined number, the mean sheet acquisition time and standard deviation for all sheets successfully fed is determined.

Then, in step S1000, the mean sheet acquisition time and the standard deviation are compared to predetermined sheet acquisition times and standard deviations. If the mean sheet acquisition time and standard deviation for the predetermined number of previously successfully fed sheets is within the predetermined range, control jumps back to step S500. Otherwise, if the mean sheet acquisition time and standard deviation for the predetermined number of previously successfully fed sheets is above or below the predetermined range, control continues to step S100. In step S1100 the blower assembly 217 is adjusted.

If the sheet acquisition time is longer than the predetermined value, the sheet fluffer pressures and the vacuum pressure applied to the sheet acquisition surface are increased to decrease sheet acquisition time. If the sheet acquisition time is shorter than the predetermined value, the sheet fluffer pressures and the vacuum pressure applied to the sheet acquisition surface are decreased to increase sheet acquisition time.

In step S1200, once the number of sheets actually fed equals the predetermined number T specified in the print request command, the control ends.

It should be understood that the control circuit 300 shown in FIGS. 1 and 2 can be implemented as portions of a suitably programmed general purpose computer. Alternatively, the control circuit can be implemented as physically distinct hardware circuits within an ASIC, or using a FPGA, a PDL, a PLA or a PAL, or using discrete logic elements or discrete circuit elements. The particular form the control circuit shown in FIGS. 1 and 2 will take is a design choice and will be obvious and predictable to those skilled in the art.

As shown in FIG. 10, the sheet acquisition time control method can be implemented on a programmed general purpose computer. However, the sheet acquisition time control sequence can also be implemented on a special purpose computer, a programmed microprocessor or microcontroller and peripheral integrated circuit elements, an ASIC or other integrated circuit, a digital signal processor, a hardwired electronic or log circuit such as a discrete element circuit, a programmable logic device such as a PLD, PLA, FPGA or PAL, or the like. In general, any device capable of implementing a finite state machine that is in turn capable of implementing the flow diagram of FIG. 10, can be used to implement the sheet acquisition time control method.

As shown in FIG. 2, the memory 320 may be implemented using a ROM. However, the memory 320 can also be implemented using a PROM, an EPROM, an optical ROM disk, such as a CD-ROM or DVD-ROM, and disk drive or the like.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A sheet feeder, comprising:

a sheet separator that separates sheets from a stack of sheets;

a feed head that acquires a sheet separated from the stack of sheets;

a sheet acquisition sensor that detects when a sheet is acquired by the feed head; and a controller that adjusts a sheet acquisition time for the feed head to acquire a sheet based on detection results from the sheet acquisition sensor.

2. A sheet feeder according to claim 1, further comprising a unidirectional drive that moves the feed head between a first position and a second position.

3. A sheet feeder according to claim 2, further comprising a take away drive that drives the sheet acquired by the feed head when the feed head is in the second position.

4. A sheet feeder according to claim 3, wherein the controller controls the take away drive.

5. A sheet feeder according to claim 1, further comprising a tray supporting the stack at a position spaced from the feed head.

6. The sheet feeder according to claim 5, wherein the controller controls a position of the tray to maintain a predetermined spacing between the stack and the feed head.

7. The sheet feeder according to claim 1, wherein the sheet separator includes a plurality of sheet fluffers that blow air at the top of the stack.

8. The sheet feeder according to claim 7, wherein the controller determines the sheet acquisition time for the sheet and compares the sheet acquisition time to a predetermined sheet acquisition time and decreases a pressure of the air blown at the top of the stack if the sheet acquisition time is less than the predetermined sheet acquisition time and increases the pressure of the air blown at the top of the stack if the sheet acquisition time is greater than the predetermined sheet acquisition time.

9. The sheet feeder according to claim 8, wherein the controller determines the sheet acquisition time and compares the sheet acquisition time to a predetermined sheet acquisition time and decreases the vacuum pressure applied to the feed head if the sheet acquisition time is less than the predetermined sheet acquisition time and increases the vacuum pressure applied to the feed head if the sheet acquisition time is greater than the predetermined sheet acquisition time.

10. The sheet feeder according to claim 1, wherein the feed head acquires the sheet by vacuum pressure.

11. A method of feeding sheets from a stack of sheets, comprising:

separating a sheet from a top of the stack of sheets;

acquiring the sheet;

sensing the acquisition of the sheet;

adjusting a time of acquiring the sheet based on the sensed sheet acquisition; and translating the sheet in a first direction.

12. The method of claim 11, wherein adjusting the time of acquiring the sheet further comprises adjusting separating of the sheets from the stack.

13. The method of claim 11, wherein adjusting the time of acquiring the sheet further comprises adjusting a position of the stack.

14. The method of claim 11, wherein adjusting the time of acquiring the sheet is based on characteristics of the sheets being fed.

15. The method of claim 11, wherein adjusting the time of acquiring the sheets is based on a mean sheet acquisition time of a predetermined number of previously fed sheets.

16. The method of claim 11, wherein separating the sheet from the top of the stack includes blowing air at the top of the stack.

17. The method of claim 16, further comprising:

determining a sheet acquisition time for acquiring the sheet;

comparing the sheet acquisition time to a predetermined sheet acquisition time; and adjusting a pressure of the air blown at the top of the stack by: 1) decreasing the pressure of the air blown at the top of the stack when the sheet acquisition time is less than the predetermined sheet acquisition time; or 2) increasing the pressure of the air blown at the top of the stack when the sheet acquisition time is greater than the predetermined sheet acquisition time.

18. The method of claim 11, wherein acquiring the sheet includes applying a vacuum pressure to the sheet.

19. The method of claim 18, further comprising:

determining a sheet acquisition time for the sheet;

comparing the sheet acquisition time to a predetermined sheet acquisition time; and adjusting the vacuum pressure by: 1) decreasing the vacuum pressure when the sheet acquisition time is less than the predetermined sheet acquisition time or 2) increasing the vacuum pressure when the sheet acquisition time is greater than the predetermined sheet acquisition time.

* * * * *